US006601332B1

(12) United States Patent
Riebling

(10) Patent No.: US 6,601,332 B1
(45) Date of Patent: Aug. 5, 2003

(54) CHILD SAFETY DEVICE, ALARM AND LOCK FOR FIREARMS

(75) Inventor: John Terry Riebling, Pittsburgh, PA (US)

(73) Assignee: Child Guard LLC, Gibsonia, PA (US)

( * ) Notice: Subject to any disclaimer, the term of this patent is extended or adjusted under 35 U.S.C. 154(b) by 0 days.

(21) Appl. No.: 09/499,539

(22) Filed: Feb. 7, 2000

(51) Int. Cl.[7] ..... F41A 17/00
(52) U.S. Cl. ..... 42/70.11
(58) Field of Search ..... 42/70.07, 70.01, 42/70.11

(56) References Cited

U.S. PATENT DOCUMENTS 3,020,663 A * 2/1962 Newson ..... 42/70.06
3,352,047 A * 11/1967 McDonnell ..... 42/70
5,392,552 A * 2/1995 McCarthy et al. ..... 42/70.07
5,450,684 A * 9/1995 Harris ..... 42/70.07
5,515,633 A * 5/1996 Harris ..... 435/6
5,544,440 A * 8/1996 Stockman ..... 42/70.07
5,561,935 A * 10/1996 McCarthy et al. ..... 42/70.07
5,638,627 A * 6/1997 Klein et al. ..... 42/70.07
5,720,193 A * 2/1998 Dick ..... 211/64
5,832,647 A * 11/1998 Ling et al. ..... 42/70.07
5,899,102 A * 5/1999 Ling ..... 70/312
5,918,492 A * 7/1999 Klebes ..... 70/203
6,209,251 B1 * 4/2001 Avganim ..... 42/70.07
6,260,299 B1 * 7/2001 Jordan ..... 42/70.11
6,276,086 B1 * 8/2001 Keaton ..... 42/70.07
6,308,540 B1 * 10/2001 Lee ..... 70/58
6,339,892 B1 * 1/2002 Ramos ..... 42/70.07

* cited by examiner

*Primary Examiner*—Michael J. Carone
*Assistant Examiner*—M. Thomson
(74) *Attorney, Agent, or Firm*—Fay, Sharpe, Fagan, Minnich & McKee, LLP

(57) ABSTRACT

Trigger lock, safety and alarm devices for a firearm includes a trigger clamp that immobilizes the devices on the firearm in a position in which the device cannot be moved with respect to the firearm to actuate the trigger and discharge the firearm. The devices include a locking mechanism that is used to mount the device to the firearm. An alarm on the device is sounded by actuation of a motion sensor when the device is moved, for example, when the firearm is moved. The alarm can be enabled and disabled using buttons mounted on the devices, and an indicator light flashes on the devices when the alarm is enabled. The keys are also used to operate the locking mechanism to lock or unlock the devices.

15 Claims, 5 Drawing Sheets

CHILD SAFETY DEVICE, ALARM AND LOCK FOR FIREARMS

BACKGROUND OF THE INVENTION

The present invention relates to safety devices, alarms and locks and, more particularly, to safety devices, alarms and locks for firearms.

Gun locks are used to reduce the incidence of accidental or unauthorized discharge of firearms. Trigger locks inhibit access to the trigger of the firearm in an effort to prevent operation of the trigger to fire the firearm. Trigger locks typically consist of two main assemblies that are mounted and locked together over or around the trigger guard and trigger of the firearm, thereby blocking access to the trigger.

Known trigger locks are, however, inadequate. Locks that employ a key to lock the two assemblies to each other on the firearm are of very limited use to those who own firearms for self defense, since ready access to the key may not be available in a perceived emergency, and, in any event, proper and quick use of the key to unlock the lock may be difficult or impossible given the stressful nature of the emergency situation.

Some of the less expensive trigger locks, often called "plastic bubbles," are plastic, and use a screw to attach the two assemblies to the firearm. These locks are fragile, and are easily removed from the firearm simply by breaking them. Additionally, the screw provides very little security, even against removal by young children who are able to use a screwdriver or other tool to remove the lock from the firearm. Further, removal of the screw is much more difficult than the use of a key in emergency situations.

Some trigger locks employ an integral mechanical combination lock to lock the assemblies to the firearm. These locks typically employ mechanical keypads with small numbered buttons or dials that are used to enter the numbered code to unlock the lock and remove it from the firearm. Manipulating the dials or operating the keypad is difficult in the dark or under stress, either or both of which conditions typically exist in an emergency situation. Locks that employ lights to illuminate the dials or keypads reveal for an intruder the position of the user when operated.

Perhaps the most inadequate feature of existing trigger locks is the manner in which access to and operation of the trigger is blocked. Many existing locks use small, fragile, hollow, plastic spring loaded pins that, presumably, are designed to pop up within the trigger guard when the lock is mounted to a firearm to fix the lock in a position that will block access to and retard movement of the trigger, as well as prevent movement of the lock on the firearm. These pins are easily broken, often unintentionally, and do not adequately secure the trigger lock to the firearm.

Often, the trigger lock itself can be used to fire a firearm after the lock is locked in place. If the trigger lock is mounted on a loaded firearm with a hammer that can be cocked, the lock will not prevent cocking the firearm. The locked firearm can be cocked and then fired by forcing the lock toward the rear of the firearm until the internal pin, or some other component of the lock, contacts the trigger and fires the firearm. This can happen unintentionally if the locked firearm is dropped onto a hard surface on the rear of the grip frame. When the frame hits the surface, the lock, due to its weight, can continue in motion and actuate the trigger.

Moreover, firearms equipped with trigger locks that have no alarm can be loaded and fired easily by a child, intentionally or by accident, either by breaking the lock or using the lock itself to fire the firearm. If using a safety device without an alarm, the gun owner or parent has no warning that a child has taken a firearm.

There exists, therefore, a need for a child safety device that incorporates an alarm and a lock for a firearm that is more effective in blocking access to and operation of the trigger, that can be easily and quickly removed from a firearm in an emergency situation, and that provides a warning that the firearm has been moved by an unauthorized person.

SUMMARY OF THE INVENTION

The present invention provides a lock for a firearm, the lock including a trigger guard clamp that can be secured to the trigger guard of the firearm to immobilize the lock on the firearm, and a locking mechanism that can be used to lock the lock onto the firearm in a position that blocks access to and actuation of the trigger of the firearm, and to unlock the lock. Preferably, the lock includes a pair of assemblies that can be locked together by the locking mechanism on the firearm to block access to and actuation of the trigger of the firearm. The lock also can include an alarm that is sounded when the lock is moved or broken to alert the owner that an unauthorized person has accessed the firearm. The alarm can be enabled and disabled using an input device, such as a keypad. Preferably, the alarm allows a preselected period of time to pass after the lock has been moved before the alarm is sounded to permit the lock to be unlocked by authorized persons, the unlocking of the lock disabling the alarm.

The present invention also provides a safety device for a firearm that blocks access to and actuation of the trigger of the firearm. The safety device includes a pair of assemblies that can be mounted on the firearm in a position in which access to and actuation of the trigger of the firearm is blocked, a locking mechanism that can be used to lock the assemblies together on the firearm, and unlock the assemblies from each other to permit removal of the assemblies from the firearm, and a locking clamp. that can be secured to the firearm to immobilize the lock with respect to the firearm. Preferably, the safety device includes an input device for operating the locking mechanism, and an alarm that is sounded a preselected time after movement of the safety device. The alarm can be enabled and disabled by using the input device. The safety device can include an indicator light that is energized when the alarm is enabled.

The present invention also provides an alarm device for a firearm that includes a lock that blocks access to and actuation of the trigger of the firearm, a locking clamp that is mounted to the firearm and the lock that immobilizes the lock with respect to the firearm, and an alarm that is sounded when the lock is moved. Preferably, the alarm device includes an input device, such as a keypad, that is used to enable and disable the alarm, and the alarm is sounded a predetermined time following movement of the lock unless the alarm is disabled. The input device can be used to lock and unlock the lock.

The present invention also provides a locking clamp device for a trigger lock including a body that defines a cutout that fits over the front of the trigger guard of a firearm, a locking hook that is positioned forward of the trigger guard when the clamp device is mounted to the firearm, and a mechanism that is used to clamp the clamp device to the trigger guard to stabilize the position of the clamp device with respect to the trigger guard.

BRIEF DESCRIPTION OF THE DRAWING

The following detailed description of the preferred embodiment may be understood better if reference is made to the appended drawing, in which.

DETAILED DESCRIPTION OF THE PREFERRED EMBODIMENT

Figure 1:
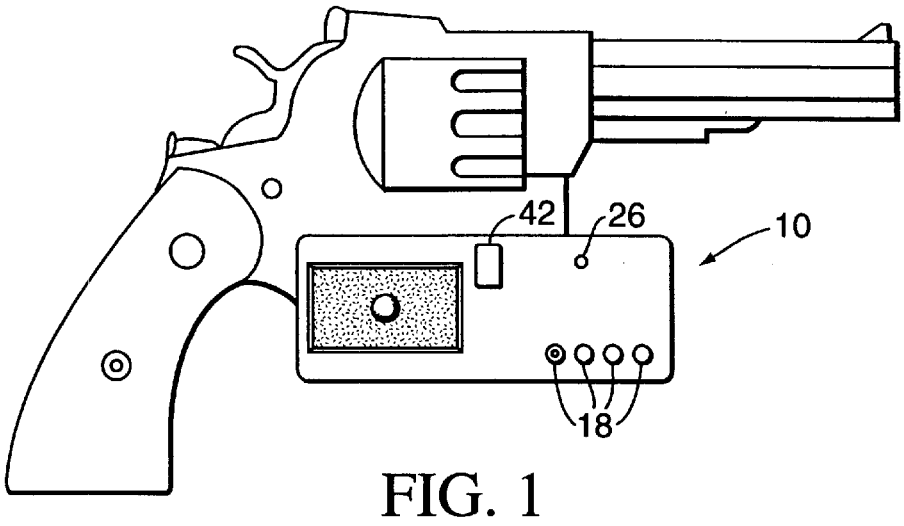
FIG. 1 shows one form of a device provided by the present invention mounted to a firearm.

The figures show a trigger lock 10, which is one embodiment of the present invention, which functions as a firearm lock, a firearm alarm and a child safety device for a firearm. Lock 10 can be used as a lock alone (it would not include an alarm feature), or it can include an alarm.

When used herein, the "plastic" means any of the advanced plastics that are commercially available.

Generally, lock 10 includes two assemblies 12 and 14 that are locked to each other around the trigger guard of a firearm both to block access to the trigger, and to hinder or block actuation of the trigger to fire the firearm. A trigger guard hook clamp 82 is secured to the trigger guard of the firearm to prevent movement of lock 10 with respect to the firearm to which it is mounted to prevent intentional or accidental actuation of the trigger by movement of lock 10. A post 154 also can be mounted behind the trigger to inhibit rearward movement of the trigger. Keypad buttons 18 are used to lock assemblies 12 and 14 together to lock lock 10 onto a firearm, and to release assemblies 12 and 14 from each other to permit removal of lock 10 from the firearm. A motion sensor 20 and horn 24 provide an alarm when the alarm feature of lock 10 is enabled and lock 10 is moved, and, therefore, to provide an audible alarm when an unauthorized person moves the firearm to which lock 10 is locked. Horn 24 is also sounded intermittently when battery power becomes low or lock, 10 otherwise loses power. An indicator light, or LED, 26 is energized, in a flashing mode, when the alarm is enabled to confirm to the owner that the alarm is set, and to dissuade movement of the firearm by unauthorized persons.

Assembly 12 includes a hard plastic case 28. Case 28 defines a chamber 30 within which motion sensor 20, microprocessor 22, horn 24, batteries 32, and locking post 40 are mounted. Locking post 40 can be metal, plastic or any other suitable material. Lock release lever 42, LED lens 27, and keypad buttons 18 are mounted through the upper surface 46 of housing 28. A plastic mounting board 36 is mounted to the surface of chamber 30 using three plastic tabs 38 that are formed integrally with board 36. Tabs 38 fit into corresponding slots formed in the walls of chamber 30. Lens 27 permits viewing of LED 26 from the exterior of case 28. A plate 11 is provided on case 28 for the application of graphics, trademarks or warnings Microprocessor 22 is mounted in any suitable fashion to upper surface 46 of board 36. Microprocessor 22 can be any suitable commercially available microprocessor that is or can be configured to receive electrical input signals and generate output signals in response thereto to perform the functions of lock 10, as described below.

Keypad buttons 18 are mounted through surface 46 of case 28, and are electrically connected to microprocessor 22 with suitable electrical leads. When it is depressed, each button 18 completes a circuit and thus produces a signal to microprocessor 22 that microprocessor 22 interprets to mean that the button 18 has been depressed. Each button 18 can be numbered, and microprocessor 22 is configured to store the sequence in which buttons 18 are depressed. Buttons 18 are used to input to microprocessor 22 the sequences in which buttons 18 must be depressed to cause microprocessor to unlock lock 10, and to enable and disable the alarm function. Depending on the sequence that is input by the user through buttons 18, microprocessor 22 will unlock lock 10, enable or disable the alarm function, or do nothing if the sequence is not recognized by microprocessor 22. Typically, a four button sequence is used to unlock lock 10, and the initial three buttons of the four button sequence is used as the alarm disable and enable sequence, that is, the sequence that will change the state of the alarm function both to enabled if the alarm is disabled and to disabled if the alarm is enabled.

Motion sensor 20 and horn 24 are mounted to upper surface 46 of mounting board 36, and connected to microprocessor 22 by suitable electrical leads. Motion sensor 20 can be any suitable commercially available sensor that produces an electrical signal when it is moved, or when it is moved with a threshold force. When lock 10 is moved, sensor 20 closes a switch internal to sensor 20 that produces a signal to microprocessor 22 that microprocessor 22 interprets as movement of lock 10. Upon receiving this signal from sensor 20 when the alarm feature is enabled, microprocessor begins an internal timer running. When the timer reaches a predetermined time, for example seven seconds, without receiving a disable sequence through buttons 18, microprocessor 22 produces an electrical signal that sounds horn 24. Horn 24 may be any suitable horn that produces an audible alarm when energized, and preferably produces sound of at most 85 decibels. LED 26 is also mounted through upper surface 46 of case 28, and is electrically connected to microprocessor 22 with suitable electrical leads. Microprocessor 22 causes LED 26 to flash or blink when the alarm function of lock 10 is enabled using buttons 18. LED 26 remains flashing until either microprocessor 22 receives a disable sequence through buttons 18, at which time microprocessor 22 deenergizes LED 26, or sensor 20 produces a signal to microprocessor 22 when lock 10 is moved, at which time microprocessor 22 begins energizing LED 26 steadily. Once LED 26 is energized steadily, it continues to be energized steadily until a disable sequence is input through buttons 18.

A pair of AAA batteries 32 is mounted within chamber 30 using suitable commercially available metal battery spring mounting clips 48 through 51. The upper ends 52 are mounted to the undersurface 54 of mounting board 36 in any suitable fashion, and depend downwardly from board 36. One battery 32 is mounted between ends 54 and 56 of clips 48 and 49, respectively, and the remaining battery 32 is mounted between ends 58 and 60 of clips 50 and 51, respectively. Batteries 32 are mounted between clips 48 through 51 through an opening 62 formed in bottom surface 64. A battery door 66 covers closes opening 62 when access to chamber 30 is not needed. Battery door 66 employs a flexible plastic hinge to secure door 66 to surface 64. Battery door 66 cannot be opened to remove the batteries and defeat the alarm feature of lock 10 when lock 10 is locked in place on the firearm due to its location on the inner surface 64 of assembly 12. Batteries 32 provide operating and control power to microprocessor 22 through clips 48 through 51 and suitable electrical leads that electrically connect clips 48 through 51 to microprocessor 22. Also, when battery power from batteries 32 falls below a preselected threshold, or when power to microprocessor 22 falls below the threshold for any other reason, microprocessor 22 sounds horn 24 intermittently.

A pair of rubber or plastic toothed gripper panels 68 and 70 are provided to protect the firearm from any potential scratching, and to inhibit movement of lock 10 with respect to the firearm to which it is mounted. Gripper panel 68 is mounted to inner surface 72 of case 28, and panel 70 is mounted to inner surface 74 of assembly 14. Panels 68 and 70 define pointed teeth 76 that engage the sides of the firearm when lock 10 is mounted on the firearm.

Assembly 14 also includes a trigger guard retaining post 78 which can be formed integrally with upper surface 74 of assembly 14, and extends through panel 70 to surface 74. Similarly, a corresponding retaining post 80 is formed on the inner surface 72 of case 28, and extends through panel 68 to surface 72. Post 80 has a slightly smaller diameter than post 78, which permits part of post 80 to slide into post 78.

A trigger guard hook clamp 82 is mounted on the retaining posts 78 and 80 when lock 10 is locked to a firearm, and prevents movement of lock 10 with respect to the firearm. Clamp 82 defines a central body 84 which defines a passage 86. Passage 86 receives retaining posts 78 and 80. Central body 84 is located between the front of the trigger guard of the firearm and the trigger when lock 10 is mounted to a firearm. Clamp 82 also defines a cutout 88 into which the front of the trigger guard of the firearm is located when lock 10 is mounted to a firearm. A locking hook or post 90 is formed integrally with central body 84, and is located outside the front of the trigger guard. Central body 84 defines a threaded hole 92 through which a set screw 94 can be threaded. Post 90 defines a threaded hole 96 through which a set screw 98 can be threaded. The hook clamp 82 can be rotated about retaining post 78 and 80 to accommodate different firearms. The position of lock 10 is fixed on the firearm by threading screw 94 through hole 92 until it contacts post 78, and then threading screw 98 through hole 96 until it contacts the front edge of the front of the trigger guard of the firearm. A trigger guard hook clamp 132 is provided for firearms having a trigger and trigger guard arrangement that does not provide a space between the trigger and the front of the trigger guard that is large enough to receive central body 84 of clamp 82. Clamp 132 defines a central body 134 that defines a hole 135 and a locking hook or post 138, and is truncated at 136. As with clamp 82, clamp 132 is mounted to assemblies 12 and 14 by inserting posts 78 and 80 through hole 135. Other than truncated section 136, clamp 132 is used and functions in the same manner as clamp 82. With some firearms, it will not be possible to mount clamps 82 or 132 to position locking posts 90 or 138 forward of the trigger guard. In those instances, adapter 140 is used with lock 10 in place of clamps 82 or 132. Adapter 140 defines a central body 142 that is placed between the trigger and the front of the trigger guard, a hole 152 that is used to mount adapter 140 onto posts 78 and 80, and a locking post or hook 144. However, rather than being positioned forward of the front of the trigger guard, post 144 is positioned to the rear of the trigger to block rearward movement and actuation of the trigger. Thus, the trigger is positioned in cutout 146 defined by clamp 140. A set screw 148 is threaded through threaded hole 150 formed in body 142 until it has been tightened against post 78 of assembly 14 to stabilize the position of lock 10 relative to lock 10. A rear trigger stop 154 is provided, which is used when either clamp 82 or clamp 132 is used. Trigger stop 154 defines a threaded end 156, which can be threaded into any one of threaded holes 158 through 160 formed in panel 70 to mount stop 154 to assembly 14. When lock 10 is mounted to the firearm, stop 154 should be located as close to the rear of the trigger as is possible to allow as little rearward movement of the trigger as possible. Accordingly, stop 154 should be threaded into whichever hole 158, 159 or 160 that accomplishes this purpose for the firearm to which lock 10 is mounted.

Locking mechanism 34 is used to lock and unlock lock 10. Mechanism 34 includes lock release lever 42, rotating locking post 40, locking post 100, and electromagnetic solenoid actuator 102. Locking post 100 can be metal, plastic or any other suitable material. Actuator 102 includes a coil 104 that surrounds a plunger 106, and plastic tab 108. Coil 104 is electrically connected to microprocessor 22 with suitable electric leads.

Rotating locking post 40 defines a series of teeth 114 along a section 118 the circumference of its inner surface 112, throughout its entire length. Locking post 100 is secured to inner surface 74 of assembly 14 in any suitable fashion. The surface of post 100 defines teeth 116 along a section 120 of its circumference throughout its entire length. Teeth 116 are adapted to mesh with teeth 114. When teeth 116 are meshed with teeth 114, longitudinal movement of post 100 with respect to post 40 is prevented, and assemblies 12 and 14 are locked together. The orientation of post 100 is fixed. However, post 40 is mounted to lever 42 and is free to rotate with lever 42. Accordingly, post 40 can be rotated by rotating lever 42. Post 40 can be rotated into a position in which teeth 114 and 116 are meshed, to lock posts 100 and 40, and, thus, assemblies 12 and 14, to each other. Similarly, post 40 can be rotated to a position in which teeth 114 and 116 are not meshed with each other to disengage post 40 from post 100, and, thus, assembly 12 from assembly 14.

Post 40 defines a hole 122 and post 100 defines a hole 126, both of which can aligned with each other to receive end 124 of plunger 106 of actuator 102. Plunger 106 can assume a position in which end 124 is extended through holes 122 and 126, and a position in which end 124 is retracted from holes 122 and 126. Plunger 106 includes a magnetic core 130 that is surrounded by a plastic shell 128. Plastic tab 108 is formed integrally with plastic shell 128 of plunger 106, and is mounted to the undersurface 54 of mounting board 36. Plastic tab 108 is flexible and can be moved by the application of a force to it. When the force is removed, tab 108 will return to its original position. Thus, tab 108 functions like a spring that biases plunger 106 toward posts 40 and 100.

When holes 122 and 126 are aligned with each other, and coil 104 of actuator is not energized, tab 108 urges plunger 106 into holes 122 and 126, which locks posts 40 and 100 to each other, and prevents the separation of assemblies 12 and 14 from each other. When coil 104 of actuator 102 is energized by microprocessor 22, the electromagnetic force generated causes plunger 106 to withdraw further into coil 104 against the force of tab 108, causing plunger 106 to be withdrawn from holes 122 and 126, which allows separation of assembly 12 from assembly 14 and unlocks lock 10. When microprocessor deenergizes coil 104, tab 108 again moves plunger 106 toward post 100.

When a user enters the unlock sequence through buttons 18, microprocessor 22 energizes coil 104 for a preselected period of time to allow the user to rotate lever 42 to unlock lock 10. If a sequence other than the unlock sequence or the alarm enable/disable sequence is entered more than five consecutive times, microprocessor 22 sounds horn 24 until the correct enable sequence is entered.

Figure 16:
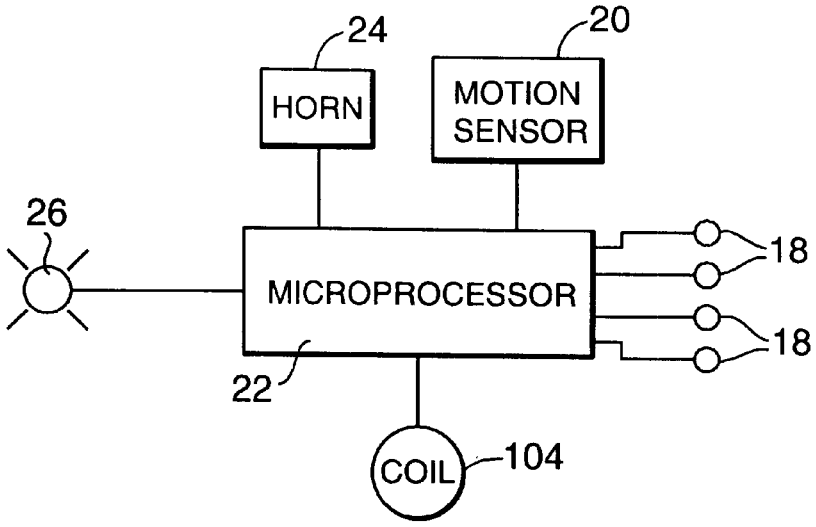
FIG. 16 is a diagrammatic view of the electrical system for the device shown in FIG. 4.

FIG. 16 shows the electrical system of lock 10. Microprocessor 22 controls the operation of horn 24, LED 26 and coil 104, based on the operation of motion sensor 20 and buttons 18. When the unlock sequence is entered through keys 18, microprocessor 22 energizes coil 104 for a preselected period of time, causing plunger 106 to be withdrawn from holes 122 and 126, which allows rotation of lever 42, and corresponding rotation of post 40, until teeth 114 and 116 are no longer engaged, and assemblies 12 and 14 can be separated from each other to remove lock 10 from the firearm. Entry of the alarm enable sequence through keys 18 causes microprocessor 22 to flash LED 26. When the alarm is enabled, movement of assembly 12 will cause motion sensor to signal microprocessor 22 to commence the alarm period for a preselected period of time. If the unlock sequence or the enable/disable sequence is not entered through keys 18 during the alarm period, microprocessor will sound horn 24 and energize LED 26 steadily. When lock 10 is in the alarm period and the enable/disable sequence or the unlock sequence is entered through keys 18, microprocessor deenergizes LED 26, and does not sound horn 24. When the alarm is enabled and the disable sequence is entered through keys 18, microprocessor causes lock 10 to assume the alarm disabled mode. When the alarm is disabled, movement of motion sensor 10 has no effect on microprocessor 22 or on lock 10.

Figure 2:
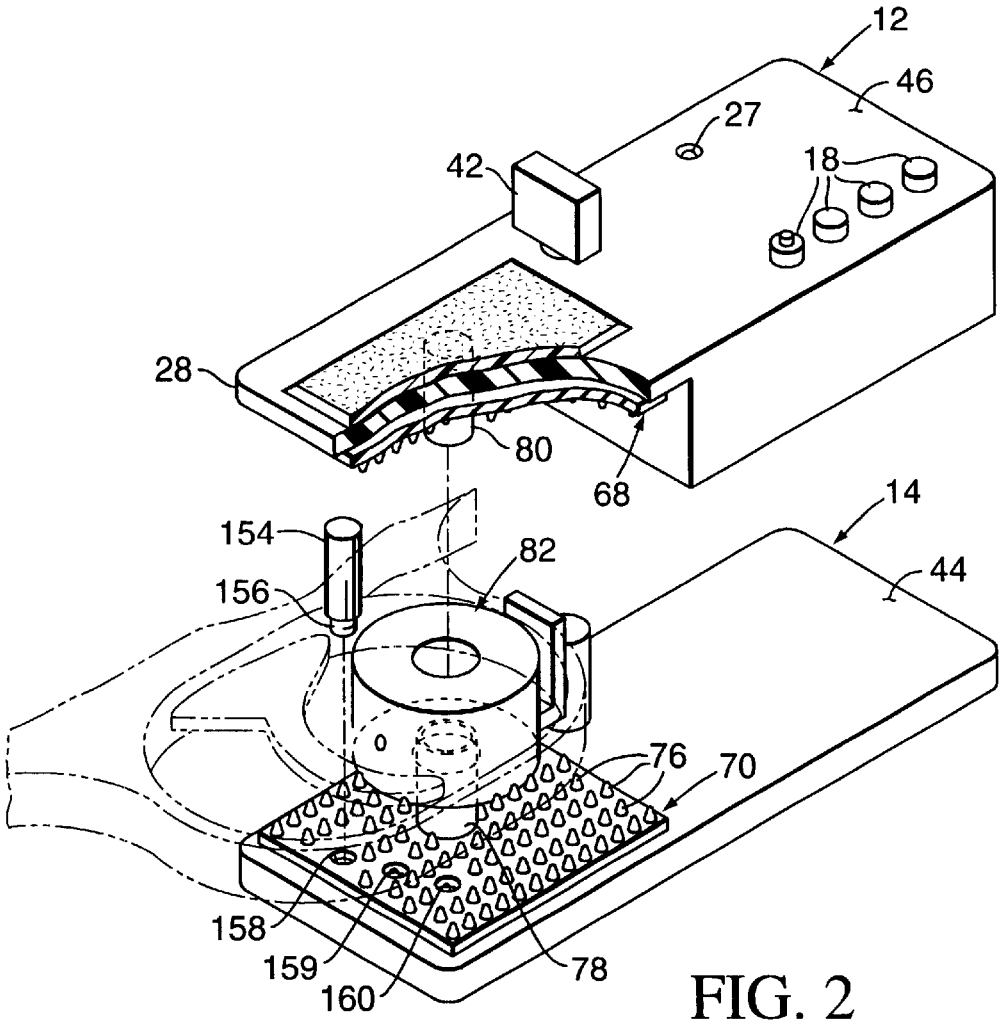
FIG. 2 is a partial exploded view, in perspective, of the device shown in FIG. 1, in relation to the trigger guard of a firearm.
Figure 3:
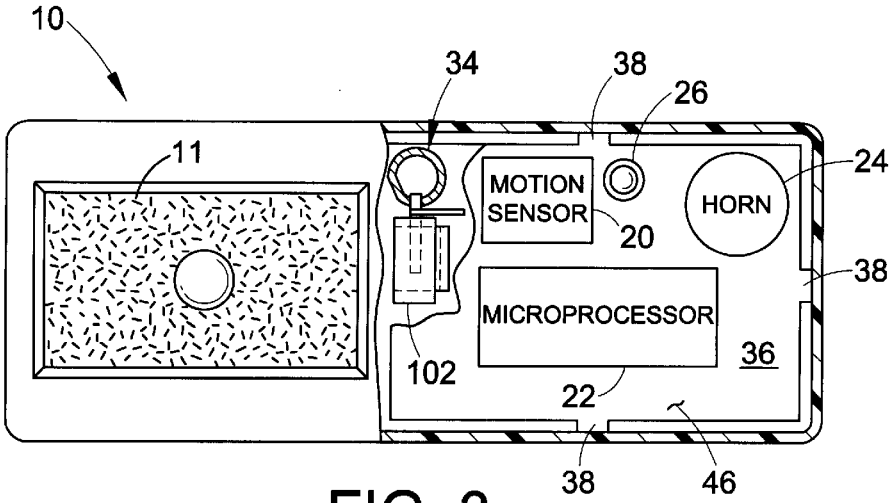
FIG. 3 is a top view, in partial section, of the device shown in FIG. 4, taken along the line 3—3.
Figure 4:
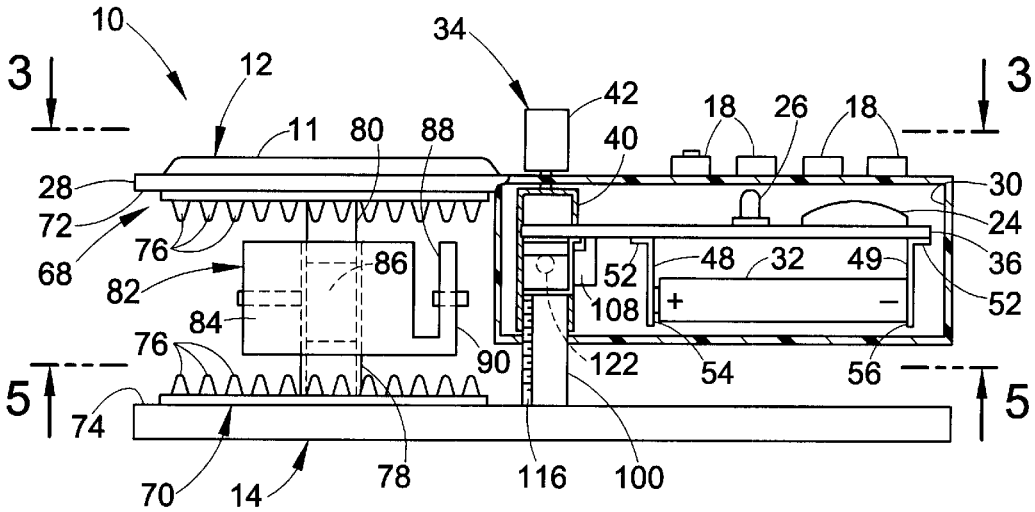
FIG. 4 is a side view of the device shown in FIG. 1.
Figure 5:
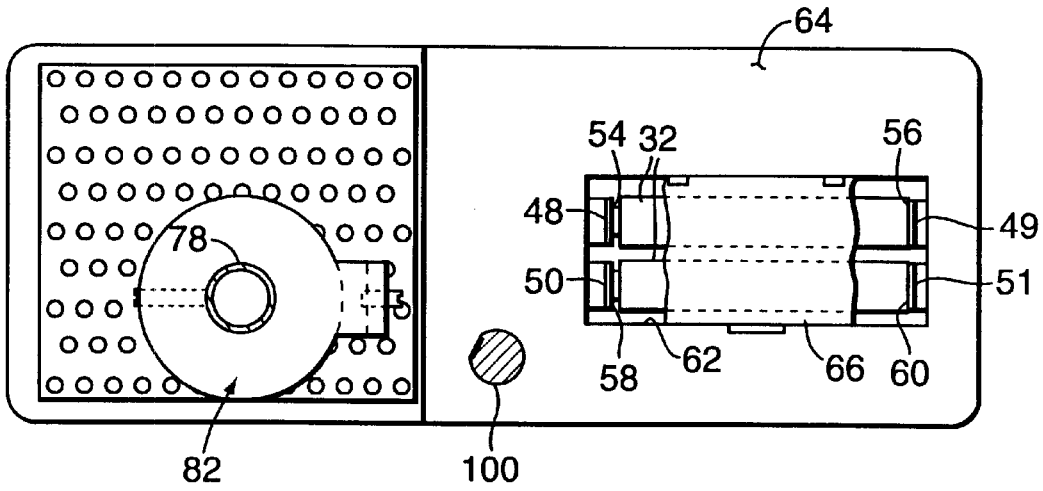
FIG. 5 is a top plan view of one of the assemblies of the device shown in FIG. 4,. taken along the line 5—5.
Figure 6:
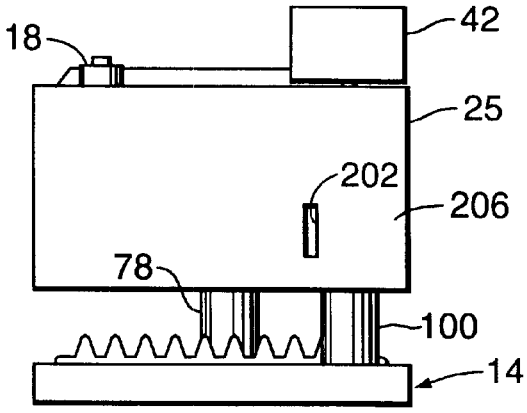
FIG. 6 is a front elevation view of the device shown in FIG. 4.
Figure 7:
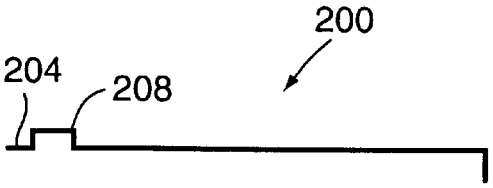
FIG. 7 shows a mechanical key for the device shown in FIG. 4.
Figure 10:
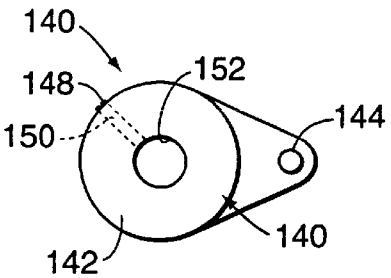
FIG. 10 is a top plan view of an adapter for use in place of a trigger guard hook clamp with the device shown in FIG. 4.
Figure 9:
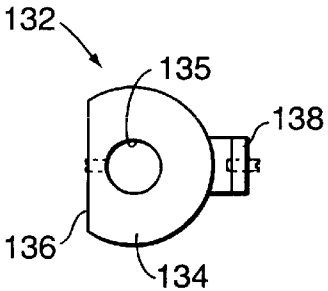
FIG. 9 is a top plan view of an alternate trigger guard hook clamp for the device shown in FIG. 4.
Figure 8:
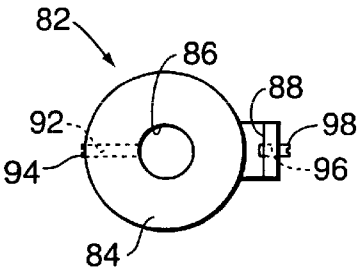
FIG. 8 is a top plan view of the trigger guard hook clamp of the device shown in FIG. 4.
Figure 13:
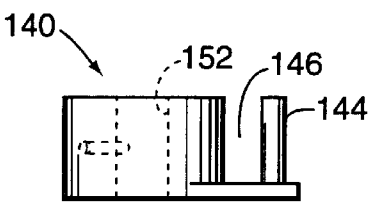
FIG. 13 is a side elevation view of the adapter shown in FIG. 10.
Figure 12:
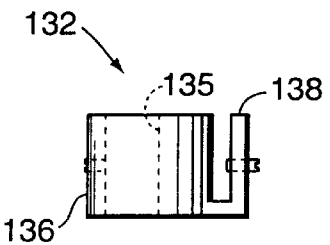
FIG. 12 is a side elevation view of the clamp shown in FIG. 9.
Figure 11:
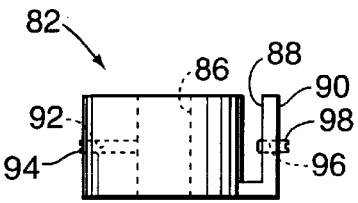
FIG. 11 is a side elevation view of the clamp shown in FIG. 8.
Figure 14:
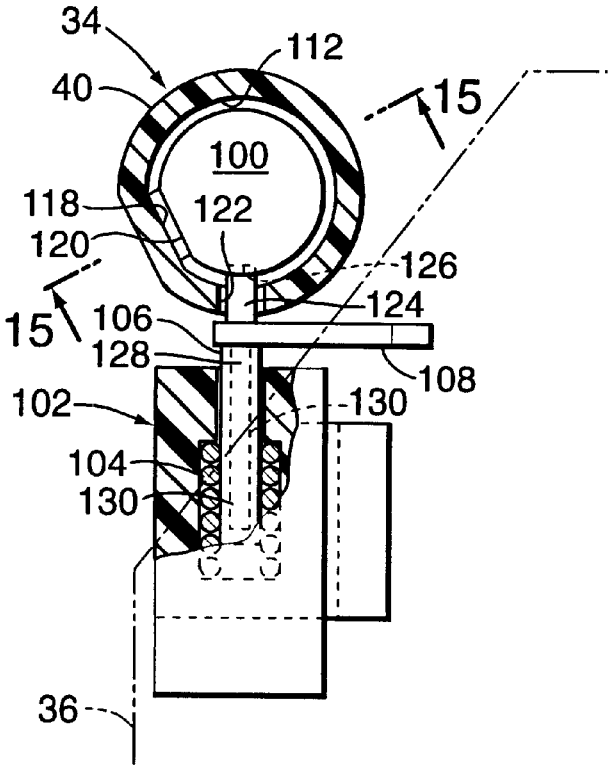
FIG. 14 is a detail view of the locking mechanism for the device shown in FIG. 4.
Figure 15:
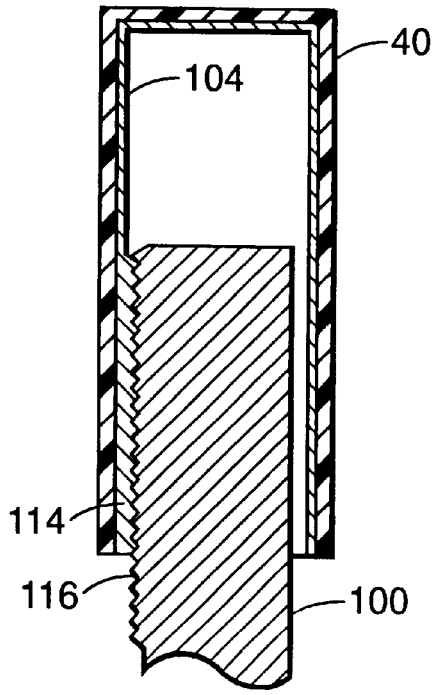
FIG. 15 is a sectional view of the mechanism shown in FIG. 14 taken along the line 15—15.

Operation and use of lock 10 should be apparent from the foregoing. Lock 10, using a clamp 82, is mounted to a firearm by inserting post 78 of assembly 14 through hole 86 in clamp 82. Clamp 82 is positioned to allow the front of the trigger guard to be positioned in cutout 88, and hook 90 to be positioned in front of the trigger guard. Assembly 14 is positioned on the firearm generally as shown in FIG. 2, to position the front of the trigger guard in cutout 88 of clamp 82. Set screw 94 is then threaded through hole 92 until it has been tightened against post 78, and set screw 98 is threaded through hole 96 until it has been tightened against the front of the trigger guard. Rear trigger stop 154 is threaded into whichever hole 158, 159 or 160 positions stop 154 the closest to the rear edge of the trigger. Assembly 12 is positioned on assembly 14 to allow post 40 to slip over post 100, and to allow post 80 to be inserted in post 78. When the exposed end of plunger 106 engages the top of post 100, the unlock sequence is entered through keys 18 to withdraw plunger 106 and allow post 40 to be fully inserted over post 100. Upon expiration of the unlock period, tab 108 will force the end of plunger 106 against the exterior of post 40. Lever 42 is rotated until holes 122 of post 40 and 126 of post 100 are aligned, at which point the end of plunger 106 is urged through holes 122 and 126 to lock posts 40 and 100 together, effectively locking lock 10 onto the firearm. At this point, the trigger of the firearm is not accessible to the user, and is prevented from rearward movement that would fire the firearm. To unlock lock 10 to remove it from the firearm, the unlock sequence is entered through keys 18 during the alarm period, which typically will be initiated upon movement of the firearm to access the keys 18 when the alarm is enabled. When the unlock sequence is entered through keys 18, the alarm period will be terminated without sounding horn 24 (if the alarm was enabled), and microprocessor 22 will withdraw the end of plunger 106 for the preselected unlock period. During the unlock period, the user can rotate lever 42, and separate assemblies 12 and 14 from each other to remove lock 10 from the firearm to ready the firearm for firing. Upon expiration of the unlock period, coil 104 will be deenergized by microprocessor 22 and tab 108 will urge plunger 106 toward post 40. If assemblies 12 and 14 are still joined, and holes 122 and 126 are still aligned with each other, plunger 106 will enter holes 122 and 126, and lock 10 will remain locked on the firearm.

If battery power fails, either due to a malfunction, or to the eventual drainage of batteries 32, lock 10 will fail in the locked position. Lock 10 can be unlocked manually with the use of key 200. To unlock lock 10 manually, end 204 of key 200 is inserted into key slot 202 in side 206 of case 28. End 204 is maneuvered within case 28 until it is adjacent tab 108, and then key 200 is rotated until raised section 208 bears against tab 108 and pushes it far enough toward actuator 102 that plunger 106 is withdrawn from holes 122 and 126, permitting rotation of lever 42, which unlocks lock 10. Assemblies 12 and 14 can then be removed from the firearm to, for example, replace batteries 32.

While making the locking posts 40 and 100 of plastic exposes lock 10 to the risk of breakage by an unauthorized user and access to the trigger by the unauthorized user, the alarm feature of lock 10 will alert anyone nearby that unauthorized access has occurred.

What is claimed is:

1. A safety device for a firearm having a trigger guard and a trigger disposed inside the trigger guard, said safety device comprising:

a pair of assemblies mountable to the firearm for blocking access to and actuation of the trigger;

a locking mechanism connected to said pair of assemblies for locking said assemblies together on the firearm and unlocking said assemblies for the removal of said assemblies from the firearm; and a hook adapted to be secured to at least one of said pair of assemblies, said hook having a first portion for extending between the front of the trigger guard and the trigger, a second portion for extending outside of the front of the trigger guard when said at least one of said pair of assemblies is mounted to the firearm to prevent movement of the safety device with respect to the firearm, and a screw extending into said second portion for contacting the trigger guard.

2. The safety device defined in claim 1 wherein the first portion is adapted to be moved relative to said at least one of said pair of assemblies to change the position of said hook relative to the firearm thereby accommodating diferent sized firearms.

3. The safety device defined in claim 2 said first portion is rotatable relative to said at least one of said pair of assemblies to change the position of said hook relative to the firearm.

4. The safety device defined in claim 3, further including a retaining post extending from at least one of said pair of assemblies for connecting said hook to said safety device.

5. The safety device defined in claim 4 further including a screw extending into said first portion for contacting said retaining post to fix said hook to said retaining post and to at least one of said pair of assemblies.

6. The safety device defined in claim 1 further including a stop pin removably connectable to at least one of said pair of assemblies in a variety of locations to prevent rearward movement of the firearm trigger.

7. A safety device for a firearm having a trigger guard and a trigger disposed inside the trigger guard, said safety device comprising:

a pair of assemblies mountable to the firearm for blocking access to and actuation of the trigger;

a lock connected to said pair of assemblies for locking said assemblies together on the firearm and unlocking said assemblies for the removal of said assemblies from the firearm;

a hook for mounting to at least one of said first and second assemblies and having a first portion and a second portion extending from said first portion to form a cutout for receiving a portion of the firearm between the first and second portions, said hook being movable relative to said at least one of said pair of assemblies to change the position of said cutout to accommodate different firearms; and a fastener for securing said hook to at least one of said pair of assemblies to prevent movement of the hook with respect to the safety device.

8. The safety device defined in claim 7 further including a retaining post extending from at least one of said pair of assemblies for connecting said hook to said safety device, wherein said hook is rotatable about said retaining post to change the position of said cutout to accommodate different firearms.

9. The safety device defined in claim 8 further including a screw extending into said first portion for contacting said retaining post to fix said hook to said retain post and to at least one of said pair of assemblies.

10. The safety device defined in claim 7 further include a screw extending into said second portion for contacting the trigger guard.

11. The safety device defined in claim 7 further including a stop pin removably connectable to at least one of said pair of assemblies in a variety of locations to prevent rearward movement of the firearm trigger.

12. The safety device defined in claim 7 further including a fastener for securing said hook to said retaining post to prevent movement of the hook with respect to the safety device.

13. A safety device for a firearm having a trigger guard and a trigger disposed inside the trigger guard, said safety device comprising:

a pair of assemblies mountable to the firearm for blocking access to and actuation of the trigger;

a lock connected to said pair of assemblies for locking said assemblies together on the firearm and unlocking said assemblies for the removal of said assemblies from the firearm;

a hook for mounting to at least one of said first and second assemblies and having a first portion and a second portion extending from said first portion to form a cutout for receiving a portion of the firearm between the first and second portions; and a retaining post extending from at least one of said pair of assemblies for connecting said hook to said safety device, wherein said hook is rotatable about said retaining post to change the position of said cutout relative to said assemblies to accommodate different firearms.

14. The safety device defined in claim 13 further include a screw extending into said second portion for contacting the trigger guard.

15. The safety device defined in claim 13 further including a stop pin removably connectable to at least one of said pair of assemblies in a variety of locations to prevent rearward movement of the firearm trigger.

* * * * *